US008079161B2

(12) United States Patent
Drollinger et al.

(10) Patent No.: US 8,079,161 B2
(45) **Date of Patent: *Dec. 20, 2011**

(54) SPORTS SHOE

(76) Inventors: Andrea Drollinger, Engelsbrand (DE); Frank Drollinger, Engelsbrand (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/437,903

(22) Filed: May 8, 2009

(65) Prior Publication Data

US 2009/0272011 A1 Nov. 5, 2009

Related U.S. Application Data

(62) Division of application No. 10/532,277, filed on Apr. 21, 2005, now Pat. No. 7,549,239.

(30) Foreign Application Priority Data

| | | |
|---|---|---|
| Oct. 26, 2002 | (DE) | 102 49 995 |
| Dec. 23, 2002 | (DE) | 102 61 907 |
| Mar. 13, 2003 | (DE) | 103 10 975 |

(51) Int. Cl.
*A43B 5/00* (2006.01)
*A43C 15/02* (2006.01)

(52) U.S. Cl. ..... 36/134; 36/127

(58) Field of Classification Search ..... 36/134, 36/127, 128, 126, 39, 7.6, 15
See application file for complete search history.

(56) References Cited

U.S. PATENT DOCUMENTS

| | | | | |
|---|---|---|---|---|
| 1,998,921 | A * | 4/1935 | Brown | 36/7.7 |
| 2,002,706 | A * | 5/1935 | Mong | 36/7.6 |
| 2,268,057 | A * | 12/1941 | Newman | 36/126 |
| 3,631,614 | A * | 1/1972 | Rice | 36/61 |
| 3,782,011 | A * | 1/1974 | Fisher | 36/59 R |
| 3,816,946 | A * | 6/1974 | Davis et al. | 36/67 D |
| 3,882,614 | A * | 5/1975 | Albaladejo | 36/67 D |
| 5,906,388 | A * | 5/1999 | Neiley | 280/613 |
| 6,035,559 | A * | 3/2000 | Freed et al. | 36/134 |
| 6,360,455 | B1 * | 3/2002 | Seo | 36/61 |
| 7,549,239 | B2 * | 6/2009 | Drollinger et al. | 36/134 |
| 7,654,014 | B1 * | 2/2010 | Moore et al. | 36/127 |

FOREIGN PATENT DOCUMENTS

WO WO 9107108 A1 * 5/1991

* cited by examiner

*Primary Examiner* — Ted Kavanaugh

(57) ABSTRACT

There is described a sports shoe, especially a golf shoe, having a sole on which downwardly projecting ground-engaging elements are mounted or can be mounted. It is provided according to the invention that the ground-engaging elements (9), or the means (10) provided for mounting them, are guided and held to move forward and backward along an arc, especially an arc of a circle.

27 Claims, 4 Drawing Sheets

SPORTS SHOE

This application is a divisional of U.S. Utility application Ser. No. 10/532,277 filed 21 Apr. 2005 now U.S. Pat. No. 7,549,239.

BACKGROUND OF THE INVENTION

1. Field of the Invention

The present invention relates to a sports shoe for golfers.

2. Description of Related Art

Golf shoes have a more or less profiled plastic sole which, with a view to improving their grip and increasing the golfer's stability, are provided with projecting ground-engaging elements, especially spikes, that penetrate more or less deeply into the turf or into the ground. Spikes may consist of steel, or a ceramic material, and are also available as so-called soft spikes or plastic spikes. Soft spikes are prescribed on some golf courses because they are said to cause less damage to the golf course than spikes made from steel or a ceramic material. Spikes may either be firmly anchored in the sole, or may be exchangeable. In the latter case it is common practice to provide the sole with threaded holes, for example to embed metallic threaded bushes in the sole, into which spikes with a matching external thread can be screwed.

When driving the ball, especially when teeing-off, the player's trunk and waist should ideally rotate about a stationary axis which should coincide with the player's spinal column. The player should swing the golf club in upward direction, then back and in downward direction, forwards and through the position of the ball, and should finally continue the swinging movement in the direction of the envisaged target, while rotating his trunk and waist, and terminate the movement in a posture in which his breast and his pelvis are turned in the direction in which the golf ball flies. At the end of the swinging movement, the player's posture should be such that he looks in the direction of his target, with his breast and pelvis facing the target, while his left foot—if he is a right-hander—remains standing in its original direction, crosswise to the finishing line, but is clearly bent over in the direction of the target, so that the outer edge of the user's left foot points toward the ground and the inner edge of his left foot is lifted off, while his right foot has been turned into the direction of his target with the heel lifted high up from the ground. For a left-handed player, the roles of his left and right foot, respectively, are reversed so that the left foot is bent over and his right heel is lifted off the ground. During the driving movement, the player's body is subjected to heavy torsion, which propagates from the foot to the top of his spinal column and which strains his ligaments and joints. It is for this reason that golfers, especially players who practice their sport frequently and who are or not so thoroughly trained and/or have already reached a certain age—this is almost the rule with golfers—frequently suffer from strain, overstretching, tenseness, dislocation and/or pain in the region of their back and their legs. A golf shoe known from DE 100 30 917 A1, provided with a twisting plate with spikes on its heel portion, is likewise not capable of preventing these effects.

SUMMARY OF THE INVENTION

Now, it is the object of the present invention to open up a way how to mitigate the strain and damaging effects on players' bodies that occur as a result of the unnatural swinging movements performed when driving the golf ball.

This object is achieved by a sports shoe having the features defined in the claims.

While the invention will be described hereafter only with reference to a right-handed person, the explanations given apply to left-handed persons correspondingly.

When a golfer—a right-hander—wears a conventional golf shoe his left foot, which has the function to provide the necessary stability during swinging movements, cannot follow that movement because the spikes have dug into the ground or the turf. On the other hand, however, it is not possible for the golfer to lift his left foot during the swinging movement and to turn it into the swinging plane in the same was as his right foot, as the player would then loose his hold under the momentum of the movement, and would fall over forwards.

The situation is absolutely different when a sports shoe according to the invention is used: While the spikes of a sports shoe according to the invention will likewise dig into the ground, the shoe still has the capability to turn from the starting position about a limited angle into the targeted direction because the spikes are guided along an arc of a circle, preferably due to the fact that the spikes are provided on one or more movable supports that are guided and held by guide means that either have the shape of, or guide the spikes along, an arc of a circle. Consequently, the shoe is capable of rotating correspondingly relative to the spikes while the latter remain anchored in the ground. The turning movement of the left shoe occurs without the golfer's stability being endangered, as the spikes of the left shoe remain stuck in the ground during the turning movement provoked by the swinging movement.

The invention offers important advantages:

- Torsion of the body, the waist, the knee and ankle joints during the swinging movement is reduced. Even if the torsion angle is reduced by a few degrees only, this already brings great relief and alleviation to the player, as in the case of conventional golf shoes the turning movement gets ever harder as the turning angle increases and because the last degrees of the turning movement are the hardest and the most straining for the body and mark, or even exceed the upper limits of what many players can stand. A little less torsion therefore already means that the player's ligaments are no longer overstretched by the turning movement and that his joints are no longer overstrained.
- The risk of injury is greatly reduced, especially in the region of the spinal column and in the region of the ankle and knee joints. The risk of luxation, or even of a prolapse of a disk, is considerably reduced.
- The player's stability is increased in the final phase of the swinging movement as the golfer's weight is shifted from its outer edge to the forefoot during the turning movement of the shoe. The forefoot is that part of the foot by which a swinging movement can be balanced out most easily and safely.
- Playing golf is rendered less tiring and strenuous.
- Surprisingly, a considerable increase in precision is observed in the driving of golf balls. Although this result is unexpected, it is of course highly desirable as it improves the golfer's proficiency and, thus, his joy in playing.

The spikes may be guided individually in undercut, arc-shaped grooves. Preferably, they are provided on an arc-shaped, sliding support. In principle, it would be sufficient to provide the spikes on a single support, conveniently in the forefoot area of the sole. If a single support is provided only, then an embodiment should be preferred which is wide enough to accommodate a plurality of spikes or other ground-engaging elements one beside the other and one behind the other. In the heel area, spikes are of advantage, but not absolutely necessary for purposes of the invention. Preferably, however, the heel area is likewise provided with one or two supports that coact with one or more supports in the region of the forefoot and whose guide means have a common center of curvature so that the foot can turn about a defined center of rotation. This does not, however, mean that the position of the centers of curvature, about which the different supports turn, may not be spaced a little one relative to the other: It only means that the centers of curvature may not be spaced one from the other so far that the shoe will loose its capability to perform a turning movement. It must be considered in this connection that the spikes are not fixed in the ground immovably, the ground (especially in the case of turf) being a little resilient.

Just as in the case of conventional golf shoes, steel spikes, ceramic spikes or soft spikes may be employed; the spikes can be firmly connected with the supports, or may be exchangeable. The invention is not subject to any limitation in this respect. Instead of spikes, other ground-engaging elements may also be used, for example plastic projections formed integrally with the support, which improve the walking safety and stability in the same way as spikes.

Preferably, the spikes or the support can be moved forward and backward between a starting position and an end position. The spikes or the support, and its guide means, then remain in mutual engagement over the full length of the movement. For less demanding applications, for example for training purposes, one can, however, do without a defined starting position and a defined end position relative to the sole of the sports shoe. If in any such case the support should slide out of its guide means as a result of the impetus of the swinging movement, it will then have to be replaced in the guide means before the next swinging movement can be performed. The fact that the support is permitted to slide off its guide means may, however, offer advantages for training purposes because the spikes, dug into the ground, will in this case keep the supports in the respective position and, thus, mark the starting position of the feet for the next swinging movement.

In normal playing operation, it will be preferred, however, it the support is held in the shoe by the guide means undetachably.

If the sports shoe is designed to allow the respective support to slide a certain length out of its guide means, then a stop is preferably provided between the support and the guide means in order to limit the distance by which the support is allowed to slide off its guide means. Such a stop may be realized, for example, by providing both the guide means and the respective support with a shoulder, which shoulders then come to abut one against the other when the support slides off its guide means.

After having been displaced as a result of a swinging movement, the supports must be moved back to their starting position. This may be effected by the athlete turning his foot in the opposite direction before he lifts his foot to withdraw the spikes from the ground. A more comfortable possibility is achieved when each guide means is equipped with a return spring which automatically returns the support to its starting position. Such return spring may be configured, for example, as a helical spring or a pneumatic spring.

Preferably, the respective support is shorter than the guide means in which it is received. This is a precondition for the sliding capability of the system in cases where the guide means is closed on both ends. In cases where the guide means is open on one of its ends, that further development is convenient if a return spring is provided, though that further development is not compulsory if a return spring is to be provided, because the return spring might as well be accommodated inside the support. The return spring could have one of its ends anchored on that end of the guide means which abuts against the support in its starting position, while its other end could be anchored on the opposite end of the support, in which case the entire length of the guide means would be available for displacement of the support.

It is preferred if the supports do not leave the guide means or the sole completely in the course of the turning movement. Instead, they should remain securely held in or on their guide means, in which they are slidingly engaged, even in the bent-over position of the ankle. This is most conveniently achieved by providing a positive fit between the guide means and the support, especially by giving guide means the form of grooves which are undercut on both sides and which are positively engaged by a slide of complementary shape that serves as support for the spikes. Groove-and-tongue connections, especially dovetail connections, are especially well suited.

Preferably, the supports are allowed to slide off their guide means only on one side, while a stop prevents them from sliding off in the other direction.

Preferably, a stop is used to secure the supports from sliding completely off the guide means or the sole. Returning the support into the guide means or the sole may be effected by the user pushing the support back using his other foot. Preferably, however, a return spring is provided, especially a pneumatic spring.

In the case of a shoe in which the supports are permitted to slide off the guide means on one of its sides, it should be possible to return or push back the supports far enough to ensure that they will not project beyond the lateral edge of the sole. Preferably, the supports end flush with the lateral edge of the sole, beyond which they are allowed to slide, in their starting position.

The direction in which the supports slide during rotation of the body, is preferably different in the area of the heel as compared with the area of the forefoot. The common center of curvature should be positioned between the heel of the shoe and its forefoot. Preferably, it should be located approximately at the point where the zenith of the plantar surface of the foot is found.

The supports may be made from metal or from a plastic material. Preferably, they are made from a plastic material having similar properties as the plastic material used for the sole of the shoe. The supports then have a plasticity adapted to the plasticity of the remaining sole, especially as regards their flexibility. This is favorable with respect to the walking comfort and does not impair the function of the support, especially if the latter is designed as a slide and if the guide means consist of a groove in the sole in which the slide is received.

If the guide means consists of a groove in the sole and the support consists of a slide, which is received and held in the groove, this provides the advantage that the invention is integrated in the sole of the sports shoe in such a way that its dimensional effects are particularly small and walking feels the same as with any conventional sports shoe. There is, however, also the possibility to provide arc-shaped rails or brackets on the sole or in grooves, slots or similar recesses in the sole, which have their ends anchored on or, preferably, in the sole, and to provide that the supports for the spikes, which may also have the contour of an arc of a circle, slide on those rails or brackets.

In case grooves are selected as guide means for the swinging movement of the slides, such grooves may be closed on both ends. This provides the advantage that the arrangement of the slides is well protected and secure from crushing. There is, however, also the possibility to make the grooves open on one of their ends so that the respective slide is allowed to move out of its groove a certain length. This offers the advantage that the shoe is allowed to turn over a larger angle under the action of the swinging movement than would be possible if the grooves were closed on both ends. Depending on the configuration and arrangement of the slides, the angle may be in the range of up to 30 degrees, or even a little more in the case of telescoping slides. But even the smaller angles possible with grooves that are closed on both ends already bring a considerable relief for the athlete.

According to another preferred embodiment of the invention, the supports for the spikes are mounted on the sports shoe detachably. This allows the sports shoe to be selectively used with or without the equipment according to the invention. For example, it is then possible to mount the movable supports, with their spikes, on the golf show when the golfer wishes to practice the teeing-off movement many times on the driving range—an exercise which otherwise, if the golfer were to wear a conventional golf shoe, would heavily strain his ligaments and joints, which strain can be mitigated if the equipment according to the invention is mounted on the sports shoe. For a tournament, however, the equipment according to the invention could be removed from the sports shoe. Considering that the support, being guided by the guide means, moves along an arc of a circle, the axis of such movement can be configured as a physical axis of rotation of the support. Such a physical axis of rotation is well suited as guide means, or as guide means component for the support. The support may then be mounted on the sole of the sports shoe at such physical axis of rotation, or by means of such physical axis of rotation. For example, it is then possible to configure the support as a plate, which is fastened on the bottom surface of the sole by a threaded bolt acting as such axis. The threaded bolt may be screwed into a threaded bush which is embedded in the sole, especially in the metatarsal region. Other guide means, for example in the form an undercut groove or a bracket, may be arranged on the sole in the area of the tip of the shoe, for receiving and guiding a forward edge of the support, and may be arranged on the sole in the area of the heel for receiving and guiding a rear end of the support.

According to another possibility, the supports and the associated guide means may be arranged on a holder which latter may be detachably mounted on the sports shoe, especially on the latter's sole. The holder may comprise for this purpose one or more clamping means, by means of which it can be mounted on the sports shoe, for example by means of clamping jaws adapted to clamp the sole between them from the side. Another possibility of mounting the holder on the sports shoe consists in fastening it on the sports shoe by buckles. Still another possibility of mounting the holder consists in providing the holder with receiving means on which the sports shoe can be placed and can then be firmly locked be pressing it down in a way comparable, for example, with a ski binding, where the shoe is placed in the binding from above, is then pressed down and thereby locked in the binding.

If the support is of the detachable type it is of advantage to arrange the return spring so that it embraces the center point about which the support rotates.

A sports shoe according to the invention may be used not only for golfing, but also for other types of sports where swinging movements are performed and have to be balanced out, as is the case, for example, with baseball, tennis, field hockey and football. Football shoes have studs that offer resistance to rotating movements of the football player, which in view of the extreme use football players have to make of their body causes high strain to their knee joints and ankles. If the studs are mounted on the football shoes in the way proposed by this invention, so that they can move to and fro along an arc-shaped path, then strain acting on the joints is reduced and ruptures of the crucial ligaments, which are a typical result of overstraining through rotary movements, are prevented.

The sports shoe may be provided in this case with advantage with a spring-loaded release mechanism provided with a triggering level for the arc-shaped movement of the studs or of the other engaging elements.

BRIEF DESCRIPTION OF THE FIGURES

Certain embodiments are illustrated in the attached drawings in which.

Identical elements, or elements corresponding one to the other, are designated by the same reference numerals in the drawings.

DETAILED DESCRIPTION OF THE INVENTION

Figure 1:
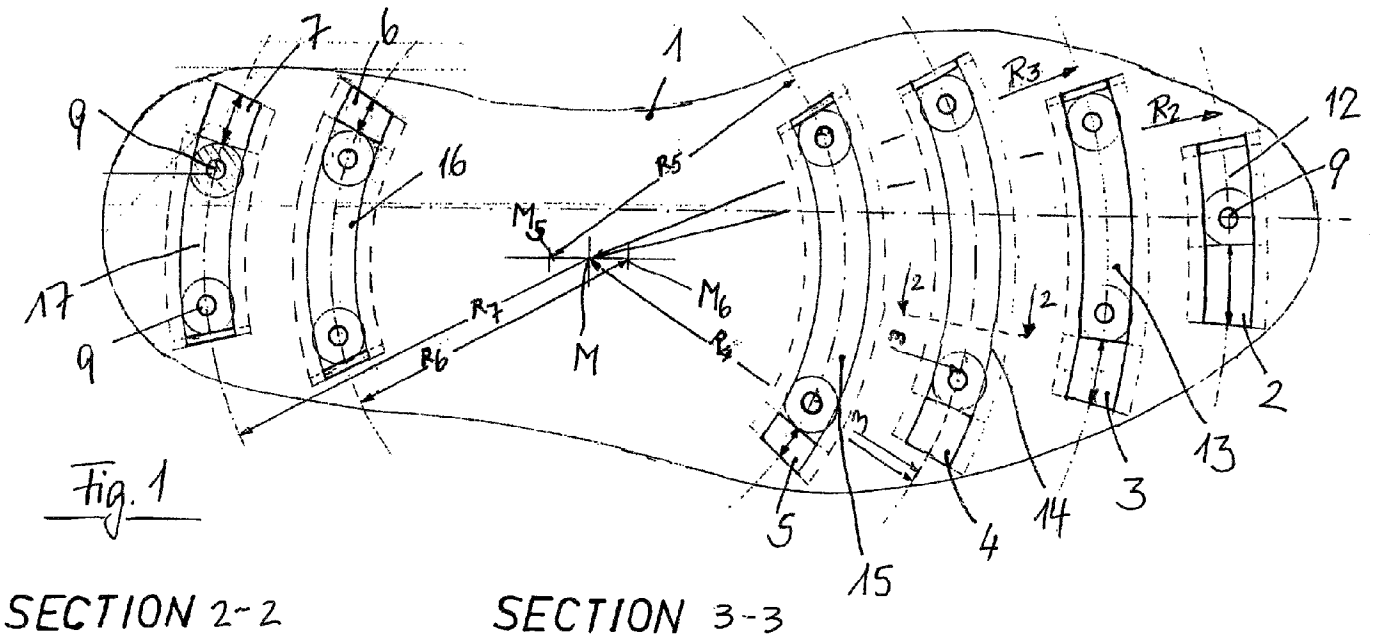
FIG. 1 shows the sole of a sports shoe according to the invention.
Figure 2:
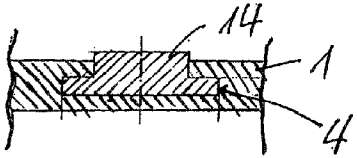
FIG. 2 shows a section along line A-A through the sole of the shoe illustrated in FIG. 1.
Figure 3:
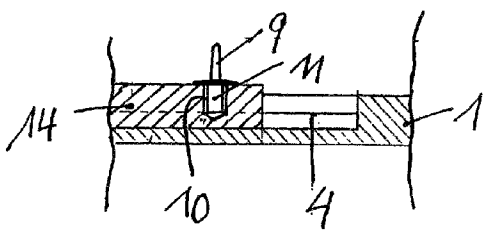
FIG. 3 shows a section along line B-B through the sole of the shoe illustrated in FIG. 1.

The sports shoe illustrated in FIG. 1 to 3 comprises a sole 1 provided with guide means consisting of four arc-shaped grooves 2 to 5 in the region of the forefoot and two further arc-shaped grooves 6 and 7 in the region of the heel, which grooves are arranged concentrically one relative to the other and whose center points M, $M_5$, $M_6$ lie between the forefoot region and the region of the heel and partly coincide one with the other. Each of the grooves 2 to 7 accommodates a slide 12 to 17, which serves as support and which is a little shorter than the respective groove. The foremost slide 12 carries a spike 9, each of the remaining slides 13 to 17 carries two spikes 9, the spikes being all arranged near the ends of the slides 13 to 17. The spikes 9 are received in threaded bushes 10 embedded in the slides 12 to 17, and are screwed into the bush by a threaded extension 11.

The slides 12 to 17 are held in the grooves 2 to 7 displaceably, but undetachably, being connected with the grooves in the way of a groove-and-tongue connection, as illustrated in FIG. 2.

The slides 12 to 17 have a starting position and an end position in the grooves 2 to 7. FIG. 1 shows the end position. In their starting position, they can abut against the opposite end of the groove, in certain cases against a return spring provided before the end of the grooves 2 to 7. The path of movement of the slides 12 to 17 between their starting position and their end position defines the angle over which the sports shoe can follow the swinging movement of a person's body. In one embodiment, illustrated in FIG. 4, that path of movement may be longer than in the embodiment illustrated in FIG. 1.

Figure 4:
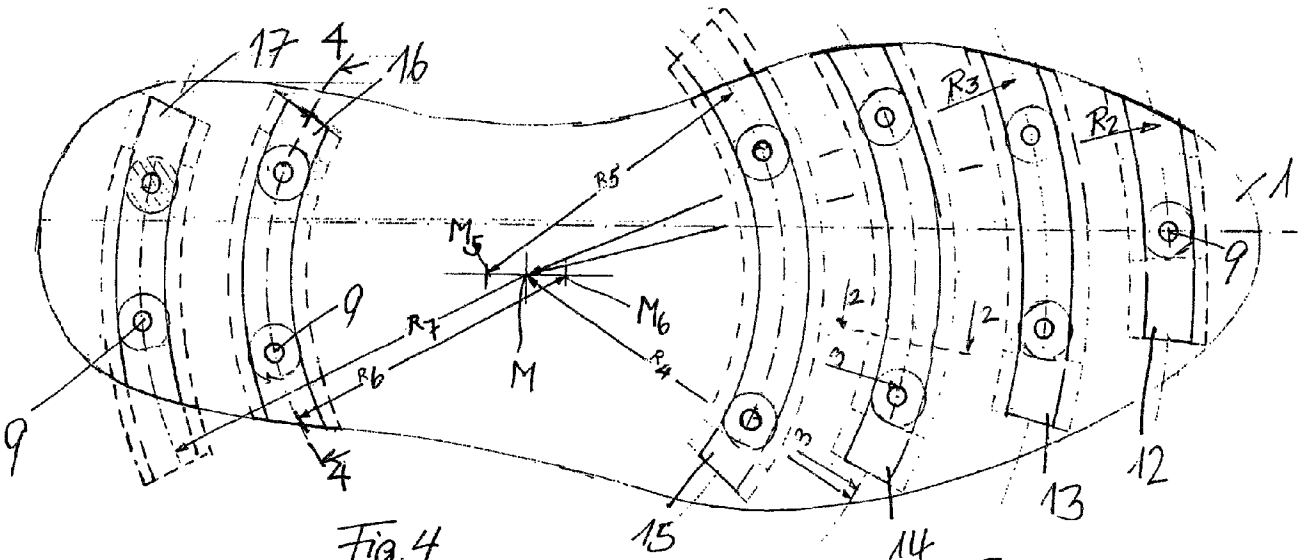
FIG. 4 shows a modified embodiment of a sports shoe in a representation similar to that of FIG. 1.
Figure 6:
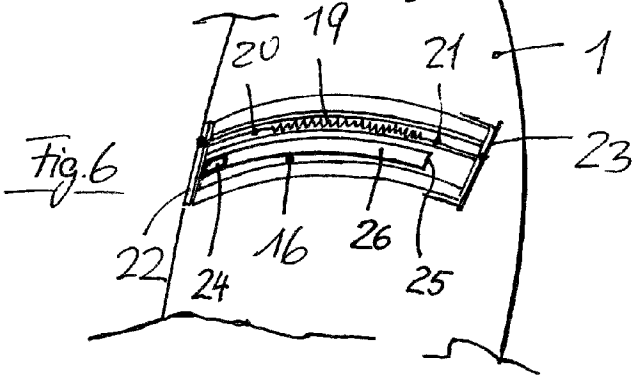
FIG. 6 shows a horizontal section along line C-C in FIG. 4.
Figure 5:
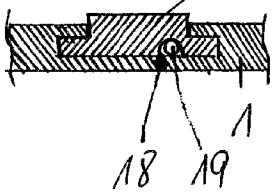
FIG. 5 shows a section, corresponding to FIG. 2, through a sole with a return spring.

In the case of the embodiment illustrated in FIG. 4, the grooves 2 to 7 are not closed on both ends but only on one end. The grooves 2 to 7 extend to the edge of the sole 1, namely in the region of the forefoot to the ends on the inner side of the foot, and in the region of the heel to the edge on the outer side of the foot. In their starting position, the slides 12 to 15 end flush with the inner edge of the sole 1, while the two slides 16 and 17 in the region of the heel end flush with the outer edge of the heel in their starting position. When the body performs a swinging movement, the slides 12 to 17 can slide a certain length off the sole 1. They can then be returned to their starting position by pushing them back using the other foot. Alternatively, they may be returned by a return spring 19, an example of which is illustrated in FIGS. 5 and 6.

The upper surface of the slide 14 is provided with an arc-shaped groove 18, which is closed toward the walking surface of the sole 1, but open toward the base of the groove 4, and which receives a return spring 19 in the form of a helical spring that has its two ends fixed on a steel cable 20, 21. A plate 22 on which the one end of the cable 21 is fixed is fastened to that end of the slide 14 that can move out of the groove 4. A plate 23 to which one end of the other steel cable 20 is fixed is fastened to the opposite end of the groove 4. Given the fact that the return spring 19 does not extend over the full length of the slide 14, it is well protected from soiling. The return spring is tensioned when the slide 14 moves out of its groove 4 as a result of a swinging movement performed by the user's body, and automatically returns the slide 14 into the groove 4 when the shoe is lifted by the user.

Another groove 26, extending in the slide 16 concentrically to the arc-shaped groove 18 and beside the latter, is open on its one end and closed on its other end, thereby forming a stop 25 which finally abuts against a stop 24 when the slide 16 is pushed out of the groove 6, the stop 24 being formed by a nose projecting from the sole into the groove 6.

Figure 7:
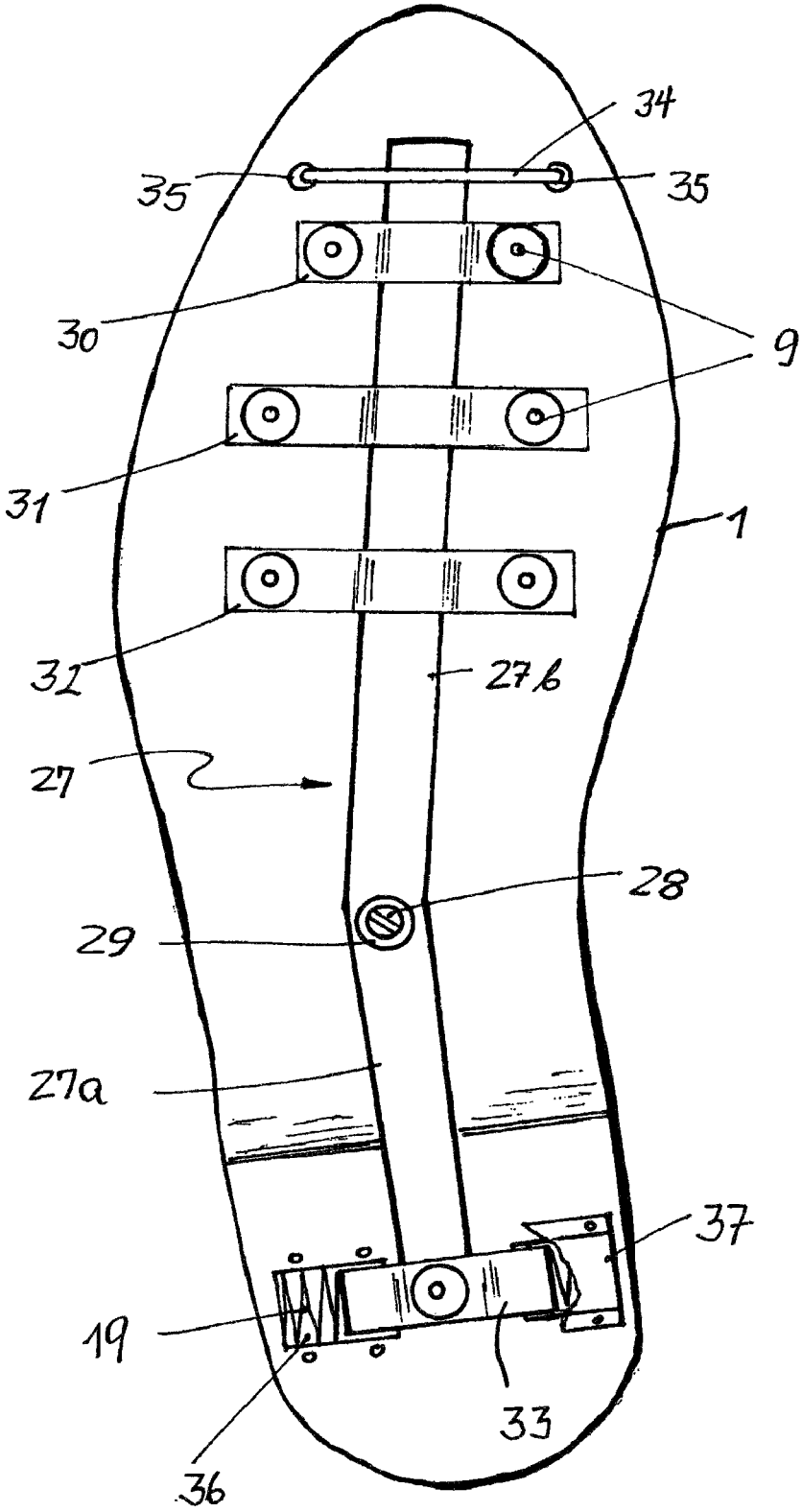
FIG. 7 shows a further embodiment of a sports shoe in a representation similar to that of FIG. 1.

In the embodiment illustrated in FIG. 7, a holder 27 is mounted rotatably on the bottom surface of the sole 1. This is achieved by a threaded bush embedded in the sole, in the region between the metatarsus and the heel, with a threaded bolt 28 fitted in the bush which secures the holder 27 to the sole 1 with the aid of a washer 29 so that the holder can be rotated about the threaded bolt 28. The holder 27 comprises two arms 27*a*, 27*b* extending in the longitudinal direction of the sole 1 and carrying cross pieces 30, 31, 32 and 33 on which spikes 9 are mounted. The forward end of the arm 27*b* reaches below a bracket 34 whose ends 35 are embedded in the sole 1. The forward end of the holder 27 is guided between the sole 1 and the bracket 34. In the region of the heel, the two ends of the cross piece 33 engage recesses 36, which are provided in the sole 1 and are covered by a covering plate 37 fastened on the sole 1; in the illustration of FIG. 7, the covering plate has been broken away in the area above one of the recesses 36, and has been completely removed from the other recess 36, in order to show the return spring 19 located underneath which acts on that end of the cross piece 33 that engages the recess 36. Irrespective of the direction in which the support 27 is rotated when a swinging movement of the user's body occurs, one of the two return springs 19 will be compressed and will thus be capable of returning the holder 27 to its starting position when the foot is lifted.

The illustrated shoes are especially well suited for use as golf shoes. It is not necessary that both shoes of one pair of golf shoes be designed according to the invention. For a left-handed person it will be sufficient if the right shoe is designed according to the invention, while for a right-handed person it will be sufficient if the left shoe is designed according to the invention.

Figure 8:
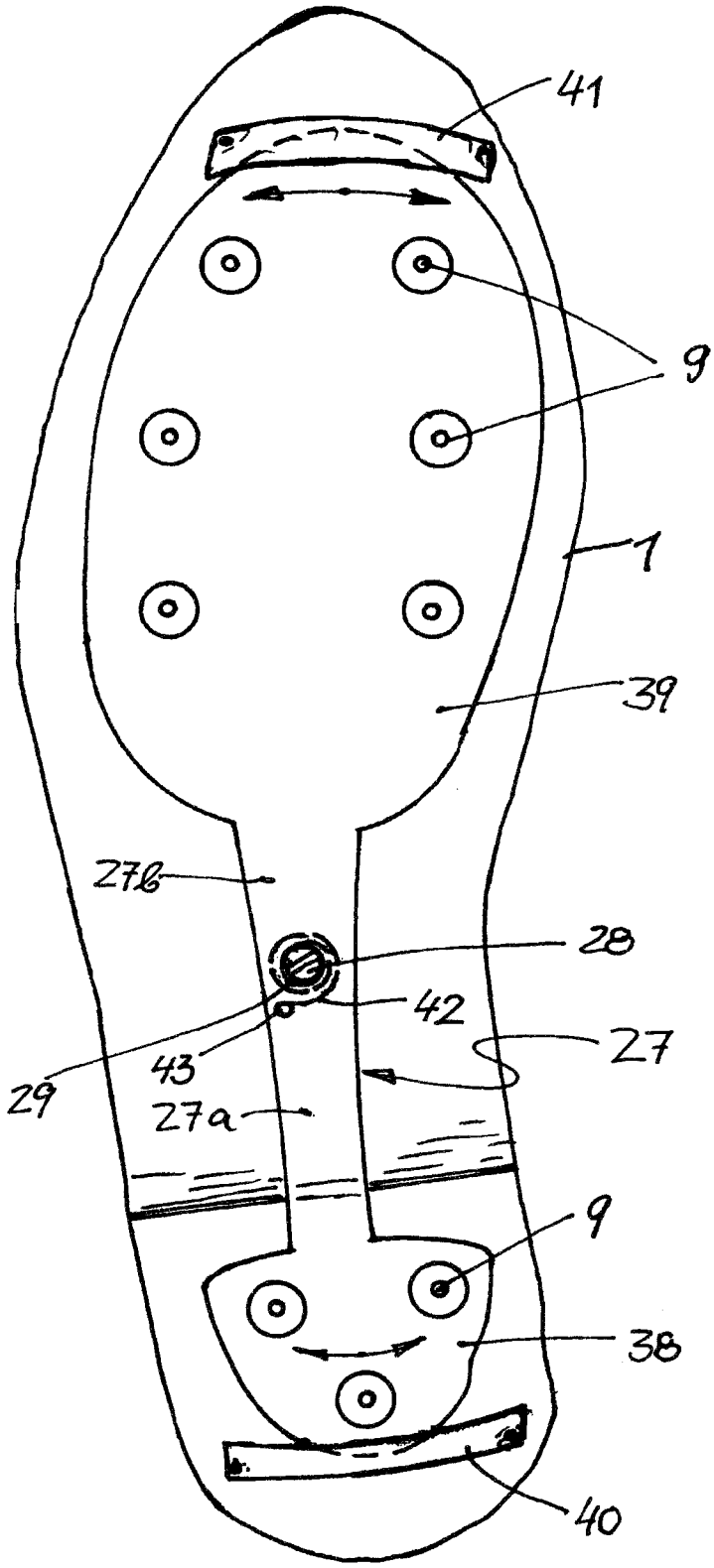
FIG. 8 shows a further embodiment of a sports shoe in a representation similar to that of FIG. 7.

The embodiment illustrated in FIG. 8 differs from the embodiment illustrated in FIG. 7 insofar that the arm 27*a* of the holder 27, which is seated for rotation about a bolt 28, transitions in the area of the heel to a plate-shaped support 38 and that the arm 27*b* of the holder 27 transitions to a plate-shaped support 39 located in the area of the metatarsus and the forefoot. The rear end of the rear support 38 and the front end of the front support 39 each engage a guide slot provided between the heel of the sports shoe and a bracket 40 fastened on the heel, or in the area of the forefoot between the sole and a bracket 41 fastened on the sole of the sports shoe. The two brackets 40 and 41 may be formed from sheet metal or a plastic material, for example. The brackets 40 and 41 may, but need not, be provided with a stop limiting the pivotal movement of the holder 27. The bolt 28, which is configured as a threaded bolt, is surrounded by a strong spiral spring 42 which has its inner end fixed on the bolt 28, or on a sleeve anchored on the sole and receiving the bolt, and has its outer end fixed on a mounting element 43, which is provided on the holder 27 and is configured as a pin directed against the sole, for example. The arrangement of the spiral spring is such that the holders are held in their central position, as shown in FIG. 8, when the spiral spring does not exert any restoring forces. When the holder moves out of its central position, in clockwise or counterclockwise direction, the spiral spring 42 produces a restoring force that tends to drive the holder back to its central position. The plate-shaped carriers 38 and 39 carry engaging elements 9, which may take the form of spikes if the sports shoe is to be used as golf shoe, or which may take the form of studs if the sports shoe is a football shoe.

The invention claimed is:

1. Sports shoe, comprising; a sole having downwardly projecting ground-engaging elements provided on at least one support and at least one arc-shaped guide for said support, the support and the ground-engaging elements being moveable along an arc transverse to a longitudinal axis of said shoe, the guide being open on at least one end so that the respective support can move a certain distance out of its guide beyond an outer edge of said sole, a stop which the support abuts in order to limit the distance by which the support can move out of the guide.

2. The sports shoe as defined in claim 1, wherein the support is a slide.

3. The sports shoe as defined in claim 1, wherein the guide is an arc-shaped groove that matches the support.

4. The sports shoe as defined in claim 2, wherein the slide is shaped in the form of an arc of a circle.

5. The sports shoe as defined in claim 1, wherein at least two supports are provided, which are arranged in substantially concentric form and each of which is held and slidably guided by a separate guide means.

6. The sports shoe as defined in claim 5, wherein at least one support is arranged in the region of the forefoot, and at least one support is arranged in the region of the heel.

7. The sports shoe as defined in claim 1, wherein the support is a slide which is adapted to slide in the guide means and which in its starting position ends flush with and closes the opening of the groove through which the support can be pushed out beyond the edge of the sole.

8. The sports shoe as defined in claim 1, wherein the support is shorter than the guide in which the support is received.

9. The sports shoe as defined in claim 1, wherein the guide coacts with a return spring that is capable of returning the support to a starting position.

10. The sports shoe as defined in claim 1, wherein the return spring is arranged in such a way that it embraces the center point of the arc of a circle.

11. The sports shoe as defined in claim 1, wherein a positive connection exists between the support and the respective guide to retain the support during displacement along the guide.

12. The sports shoe as defined in claim 11, wherein the guide is undercut along longitudinal edges and that the respective support engages the undercut.

13. The sports shoe as defined in claim 12, wherein the support has a stepped design, matching the undercuts of the guide.

14. The sports shoe as defined in claim 11, wherein the support and the guide engage each other in the way of a groove-and-tongue connection.

15. The sports shoe as defined in claim 1 wherein the support is mounted on the shoe detachably, and the support is provided on a holder which is detachably mounted on the sports shoe.

16. The sports shoe as defined in claim 15, wherein the holder comprises a receiver element on which the sports shoe can be placed and firmly locked by application of pressure from above, the support being mounted on the shoe detachably, wherein the support is provided on a holder which is detachably mounted on the sports shoe.

17. Sports shoe according to claim 1, said support being at least one arc-shaped slide which is undetachably held in a matching arc-shaped groove to slide between a starting position and an end position.

18. The sports shoe as defined in claim 17, further comprising at least two supports arranged in substantially concentric form and each support is held in a separate groove in sliding relationship.

19. The sports shoe as defined in claim 18, wherein at least one slide is arranged in the region of the forefoot, and at least one slide is arranged in the region of the heel.

20. The sports shoe as defined in claim 17, wherein the grooves are open on one of their ends so that the respective slide can move a certain length out of its groove.

21. The sports shoe as defined in claim 20, wherein the starting position of the respective slide ends flush with and closes the opening of the groove through which the slide can be pushed out beyond the edge of the sole.

22. The sports shoe as defined in claim 17, wherein the respective slide is shorter than the groove in which it is received.

23. The sports shoe as defined in claim 22, further comprising a return spring is arranged in each groove said spring is adapted to return the respective slide to its starting position.

24. The sports shoe as defined in claim 17, wherein a positive connection exists between the groove and the slide, by which the slide is retained in the groove during displacement in it.

25. The sports shoe as defined in claim 17, wherein the grooves are undercut along their longitudinal edges and that the respective slide engages the undercut.

26. The sports shoe as defined in claim 25, wherein the slide is stepped to match the undercuts of the groove.

27. The sports shoe as defined in claim 24, wherein the slide and the groove engage each other in the way of a groove-and-tongue connection.

* * * * *